US010441045B2

(12) United States Patent
Demke et al.

(10) Patent No.: US 10,441,045 B2
(45) Date of Patent: Oct. 15, 2019

(54) MULTIFUNCTIONAL BACKPACK WITH UMBRELLA HOLDER

(71) Applicant: Umbre Incorporated, Loveland, CO (US)

(72) Inventors: Kent Ray Demke, Saratoga Springs, UT (US); Tara R Savage, Gilbert, AZ (US); Levi B Savage, Gilbert, AZ (US)

(73) Assignee: Umbre Incorporated, Loveland, CO (US)

( * ) Notice: Subject to any disclaimer, the term of this patent is extended or adjusted under 35 U.S.C. 154(b) by 38 days.

(21) Appl. No.: 15/800,028

(22) Filed: Oct. 31, 2017

(65) Prior Publication Data

US 2018/0116359 A1 May 3, 2018

Related U.S. Application Data

(60) Provisional application No. 62/415,205, filed on Oct. 31, 2016.

(51) Int. Cl.

| | |
|---|---|
| ***A45C 13/40*** | (2006.01) |
| ***A45F 3/04*** | (2006.01) |
| ***A45C 15/00*** | (2006.01) |
| ***A45B 11/00*** | (2006.01) |
| *A45F 3/00* | (2006.01) |

(52) U.S. Cl.

CPC ..... *A45C 13/40* (2013.01); *A45B 11/00* (2013.01); *A45C 15/00* (2013.01); *A45F 3/04* (2013.01); *A45F 2003/001* (2013.01)

(58) Field of Classification Search

CPC ... A45C 13/40; A45B 2011/005; A45B 11/02; A45B 11/00

USPC ..... 224/186–190, 915, 200; 135/16; 248/511, 534

See application file for complete search history.

(56) References Cited

U.S. PATENT DOCUMENTS

| | | | | |
|---|---|---|---|---|
| 6,209,253 | B1 * | 4/2001 | Saldana, Jr. | A01K 97/10 224/200 |
| 2012/0111381 | A1 * | 5/2012 | Solotoff | A45B 11/00 135/20.1 |

(Continued)

FOREIGN PATENT DOCUMENTS

| | | | | |
|---|---|---|---|---|
| FR | 2878697 | A1 * | 6/2006 | A45B 3/00 |
| JP | 2007330754 | A * | 12/2007 | |
| KR | 2011001003 | A * | 1/2011 | |

OTHER PUBLICATIONS

English Translation of JP2007330754 from Espacenet, accessed on Jan. 19, 2019.*

*Primary Examiner* — Scott T McNurlen

(57) ABSTRACT

A multifunctional backpack with an integrated umbrella holder consists of a backpack, an umbrella, and a holding bracket. The holding bracket is removably positioned within a primary compartment of the backpack. Therefore, when the umbrella needs to be used in a handsfree configuration, the umbrella is positioned into the holding bracket. The position of the umbrella can be changed with the use of a plurality of height-adjusting pockets. The stability of the umbrella can be maintained with an anchoring bracket which is positioned adjacent the holding bracket. Additionally, a retainer mechanism is also used to keep the umbrella stationary in the handsfree configuration. When not used, the umbrella is stored within a waterproof compartment of the backpack.

15 Claims, 10 Drawing Sheets

(56) References Cited

U.S. PATENT DOCUMENTS

| | | | | |
|---|---|---|---|---|
| 2014/0041555 | A1* | 2/2014 | Ramberg | F16M 13/022 108/50.12 |
| 2016/0324300 | A1* | 11/2016 | Wronski | A45F 3/04 |

* cited by examiner

MULTIFUNCTIONAL BACKPACK WITH UMBRELLA HOLDER

The current application claims a priority to the U.S. Provisional Patent application Ser. No. 62/415,205 filed on Oct. 31, 2016.

FIELD OF THE INVENTION

The present invention relates generally to a backpack that supports multiple outdoor activities and allows the user to utilize an umbrella with the backpack. By utilizing the present invention, the user has the freedom to continue an activity without having to use one hand to hold the umbrella.

BACKGROUND OF THE INVENTION

In areas with varying weather conditions many people routinely carry an umbrella either to keep dry during rain or protect themselves from the sun on sunny days. Generally, the umbrella must be handheld. Holding the umbrella is practical if the umbrella is only used for a short period of time. However, for people who spend a significant amount of time outdoors, holding an umbrella can be burdensome. Thus, the present invention addresses the issue in a manner that stresses flexibility in how the umbrella is used. In particular, the present invention combines a standard umbrella with a multi-functional backpack that contains brackets for holding the umbrella when a handsfree mode is desired by the user. The brackets permit height adjustability of the umbrella to suit the needs of the user. However, the umbrella is a standard type with an ergonomic handle, and can also be used as a normal handheld umbrella if desired.

Similar to other existing backpacks, the backpack of the present invention contains various pockets and compartments to hold various types of items that a user requires when commuting, going to school, on a travel excursion, or at an outdoor event. The availability of the umbrella allows the user to utilize the umbrella in a handheld configuration or a handsfree configuration during any of the aforementioned activities. To provide flexibility in how the present invention is used, the backpack contains a waterproof pocket where the umbrella can be stored when not in use. To fulfill the handsfree configuration, the present invention contains a compartment with specially designed mounting brackets. The mounting brackets can hold the standard umbrella securely without the use of hands and thus, giving maximum flexibility to the user.

DETAIL DESCRIPTIONS OF THE INVENTION

All illustrations of the drawings are for the purpose of describing selected versions of the present invention and are not intended to limit the scope of the present invention.

The present invention introduces a multifunctional backpack that can be used with an umbrella. In particular, the present invention allows the user to store the umbrella within the multifunctional backpack and also allows the user to utilize the umbrella in a handsfree mode by mounting the umbrella into the multifunctional backpack. By utilizing the present invention, the user can carry all the necessities required during an outing. Additionally, the user can continue the outdoor activity regardless of the weather conditions since the umbrella can be used in a handsfree configuration with the multifunctional backpack.

Figure 1:
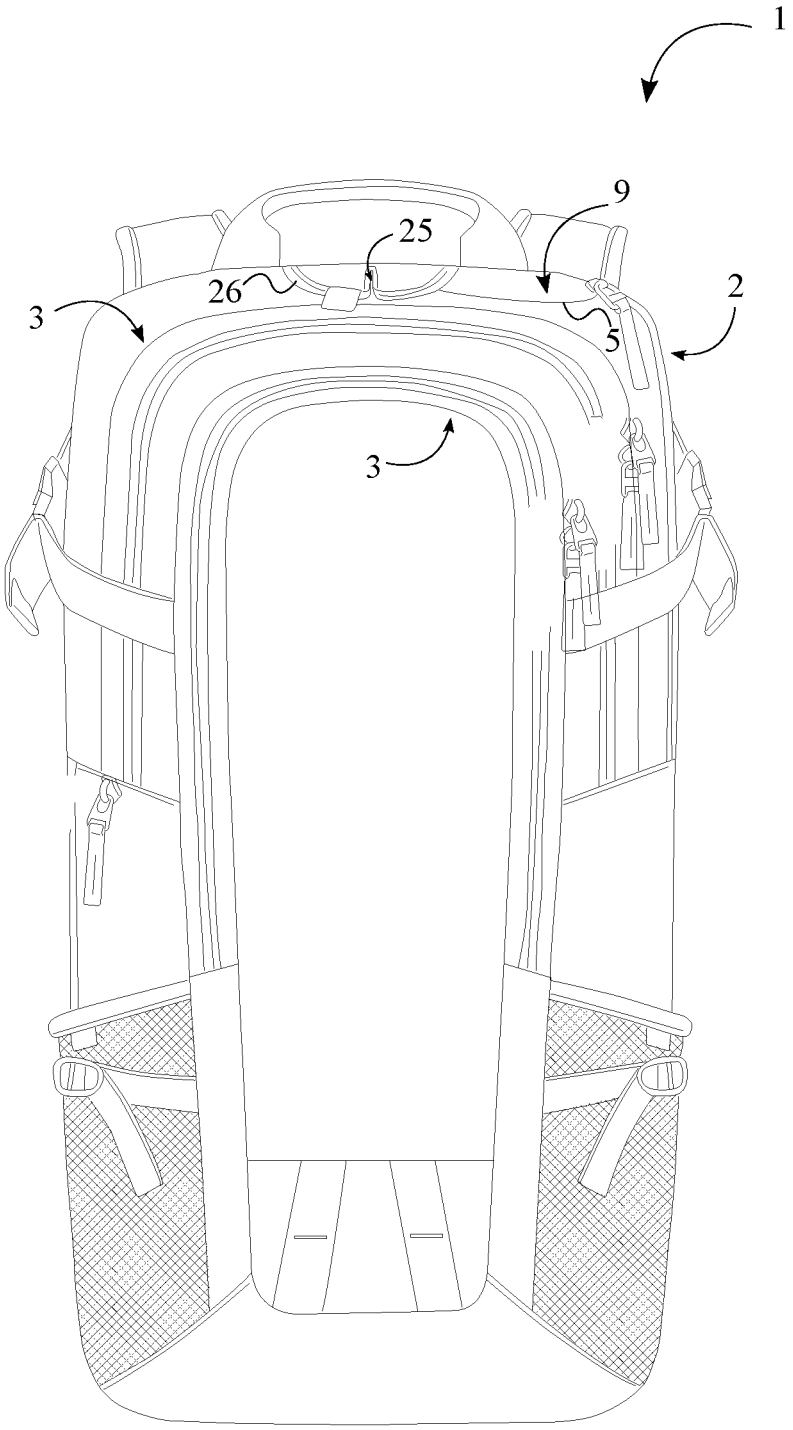
FIG. 1 is a front view of the present invention.
Figure 2:
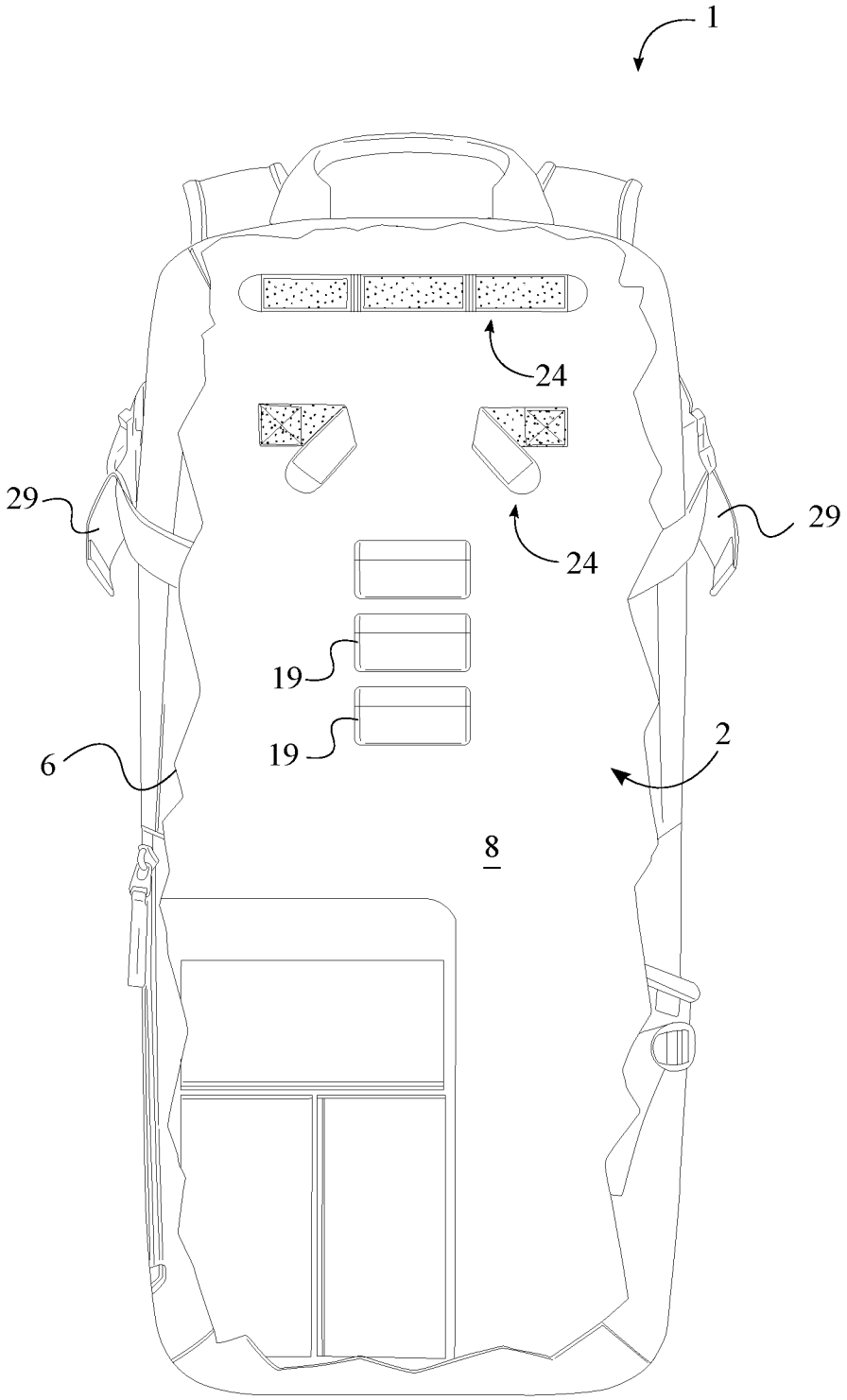
FIG. 2 is another front view of the present invention illustrating the rear portion.
Figure 3:
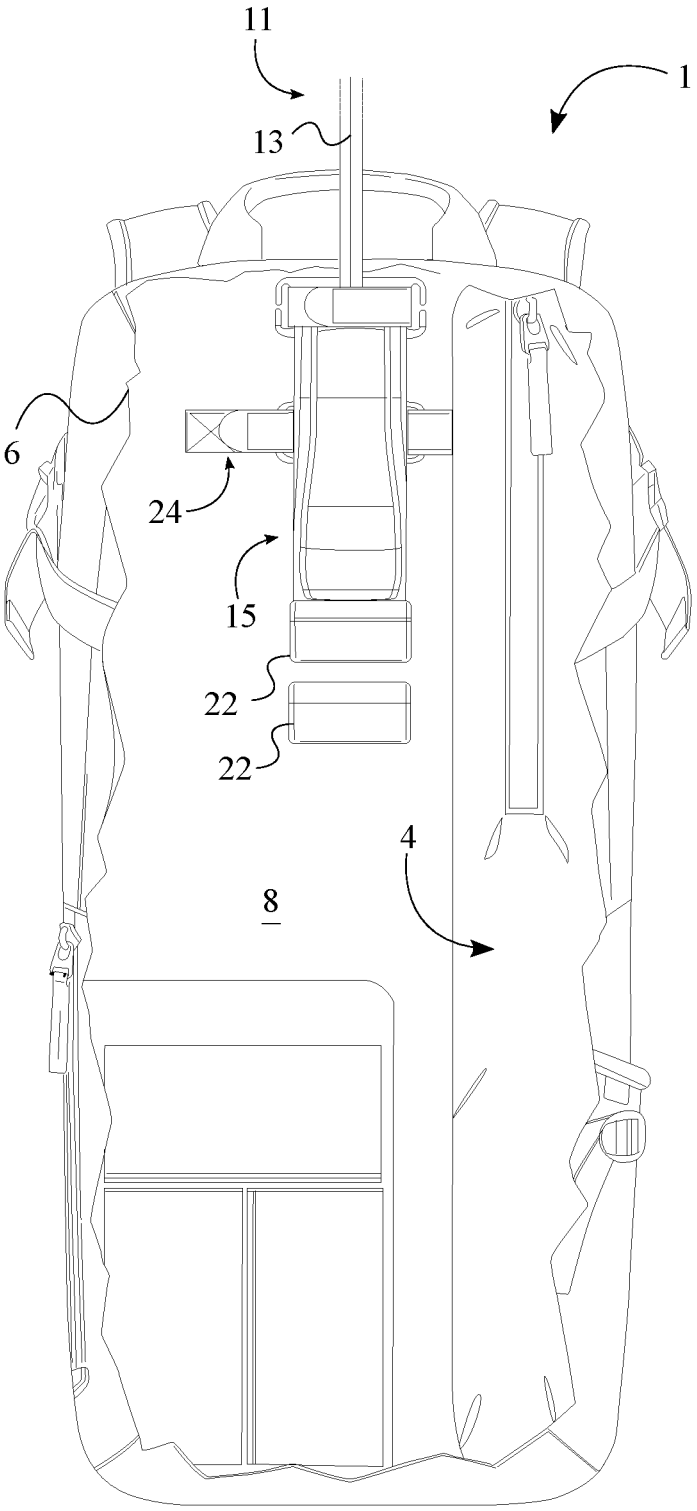
FIG. 3 is an illustration of the umbrella being mounted onto the rear portion.

As illustrated in FIGS. 1-5, the present invention comprises a backpack 1, an umbrella 11, and a holding bracket 15. The backpack 1 is used to carry all the necessities of the user along with the umbrella 11. The holding bracket 15 is used to position the umbrella 11 when the umbrella 11 is intended to be used in a handsfree configuration. In order to carry the necessities of the user in an organized manner, the backpack 1 comprises a primary compartment 2, a plurality of secondary compartments 3, and a waterproof compartment 4. The primary compartment 2 and the plurality of secondary compartments 3 are essentially used for storing and carrying the necessities of the user for an outing. The size and shape of each of the plurality of secondary compartments 3 can vary in different embodiments of the present invention. In the preferred embodiment, a set of pockets from the plurality of secondary compartments 3 is designed to position an electronic device which can be, but is not limited to, a laptop or a mobile phone. To accommodate different electronic devices, the set of pockets are preferably designed with extra padding. The items stored within the primary compartment 2 and the plurality of secondary compartments 3 can vary according to the outing which can be, but is not limited to, a hike, an outdoor concert or a daily commute. On the other hand, the waterproof compartment 4 is used to store the umbrella 11 when the umbrella 11 is not in use. The properties of the waterproof compartment 4 ensure that the items stored within the primary compartment 2 and the plurality of secondary compartments 3 are not damaged when a wet umbrella 11 is stored within the waterproof compartment 4. When considering the positioning, the plurality of secondary compartments 3 is positioned adjacent the primary compartment 2. Moreover, the waterproof compartment 4 is also positioned adjacent to the primary compartment 2. As seen in FIG. 3, in the preferred embodiment of the present invention, the waterproof compartment 4 has a vertical orientation so that the umbrella 11 can be conveniently removed and positioned. More specifically, in a stored configuration, the umbrella 11 is removably positioned within the waterproof compartment 4. As discussed before, the holding bracket 15 is used to position the umbrella 11 in the handsfree configuration. In doing so, the holding bracket 15 is removably positioned within the primary compartment 2 so that the umbrella 11 can be removably positioned into the holding bracket 15 in a handsfree configuration.

Figure 5:
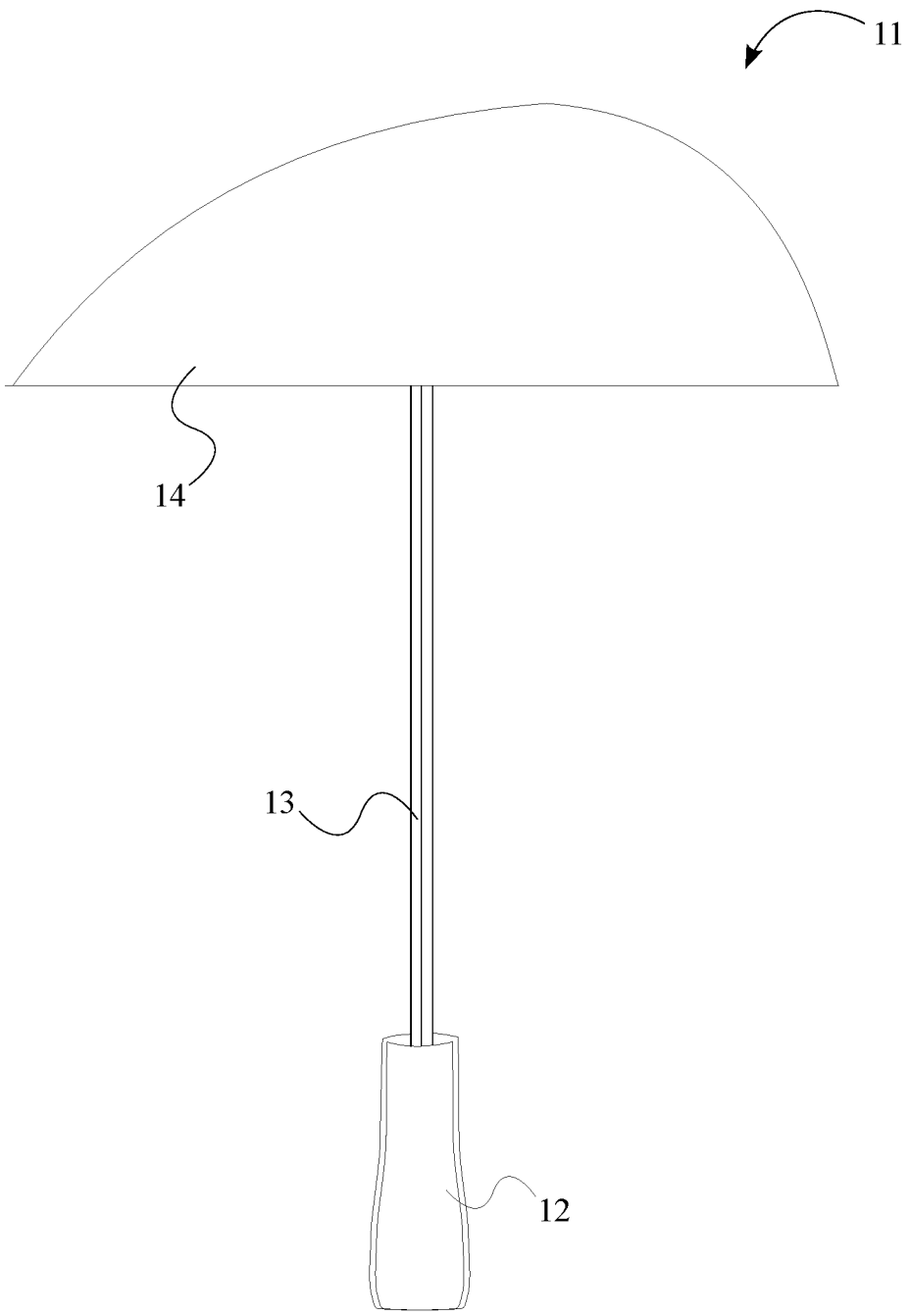
FIG. 5 is a side view of the umbrella.

The umbrella 11 of the present invention can vary in material, shape, and color in different embodiments of the present invention. Regardless of the aesthetic properties, the umbrella 11 comprises a handle 12, a shaft 13, and a canopy 14. The handle 12, that is used to hold the umbrella 11, is terminally connected to the shaft 13. The canopy 14, which provides protection from both rain and sunshine, is terminally connected to the shaft 13 opposite to the handle 12. As shown in FIG. 5, in the preferred embodiment of the present invention, the canopy 14 is elongated in shape. The elongated shape is beneficial when the user is utilizing the umbrella 11 in a crowded area such as an outdoor concert. The elongated shape positions the canopy 14 above the head of the user so that other individuals around the user are not disturbed. Moreover, an inner surface of the canopy 14 will comprise an ultraviolet (UV) coating to diminish the amount of UV radiation that passes through.

As discussed earlier, the primary compartment 2, the plurality of secondary compartments 3, and the waterproof compartment 4 are used for storage purposes. To fulfill the storage needs, the primary compartment 2, the plurality of secondary compartments 3, and the waterproof compartment 4 each comprise a rim 5 and an inner liner 6, wherein the rim 5 is perimetrically connected along an opening 9 delineated by the inner liner 6 as shown in FIG. 1. Preferably, a zipper is used along the rim 5 so that the inner liner 6 can be opened or closed per user preference.

Figure 4:
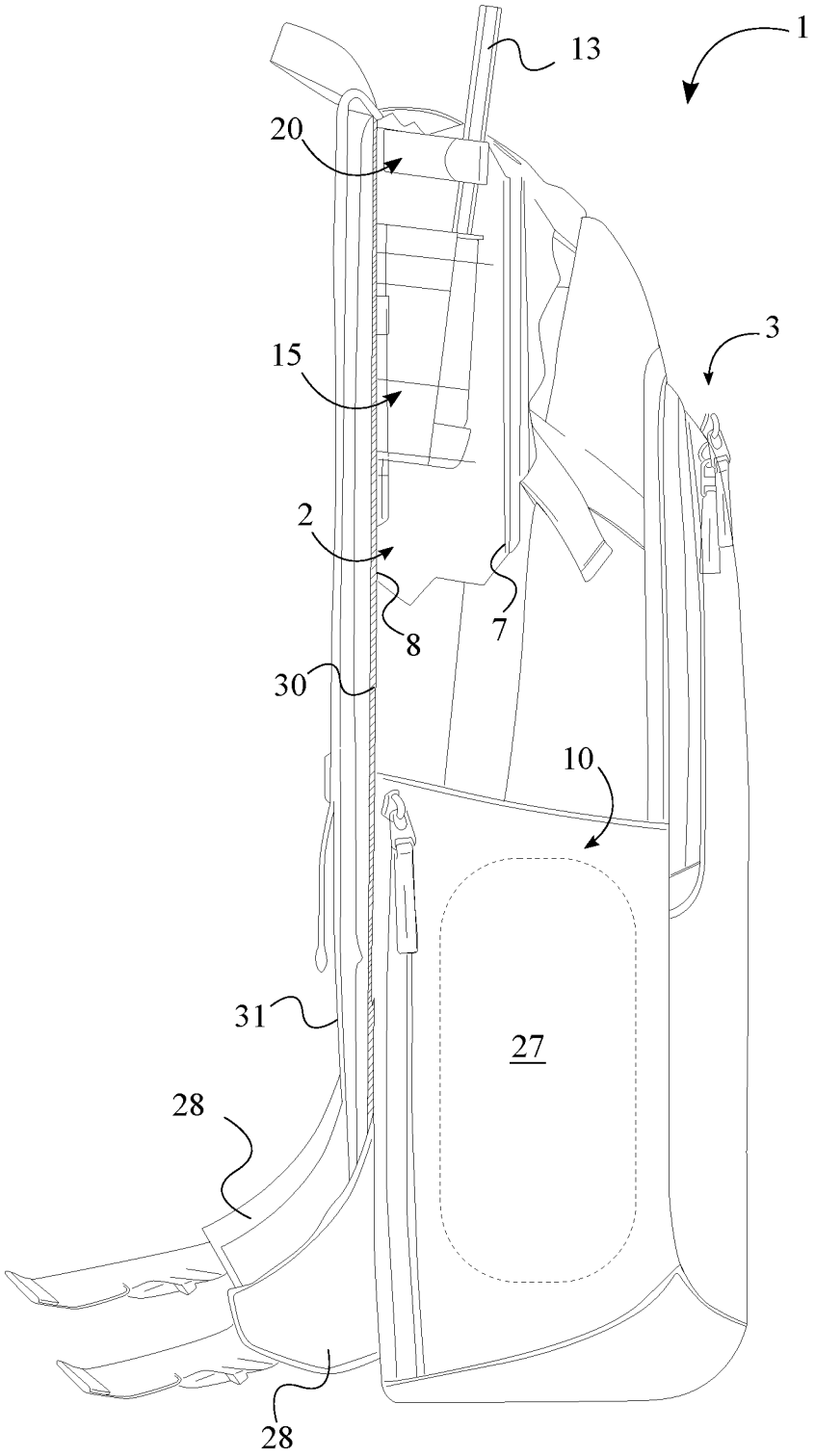
FIG. 4 is a side view of the umbrella being mounted onto the rear portion.
Figure 6:
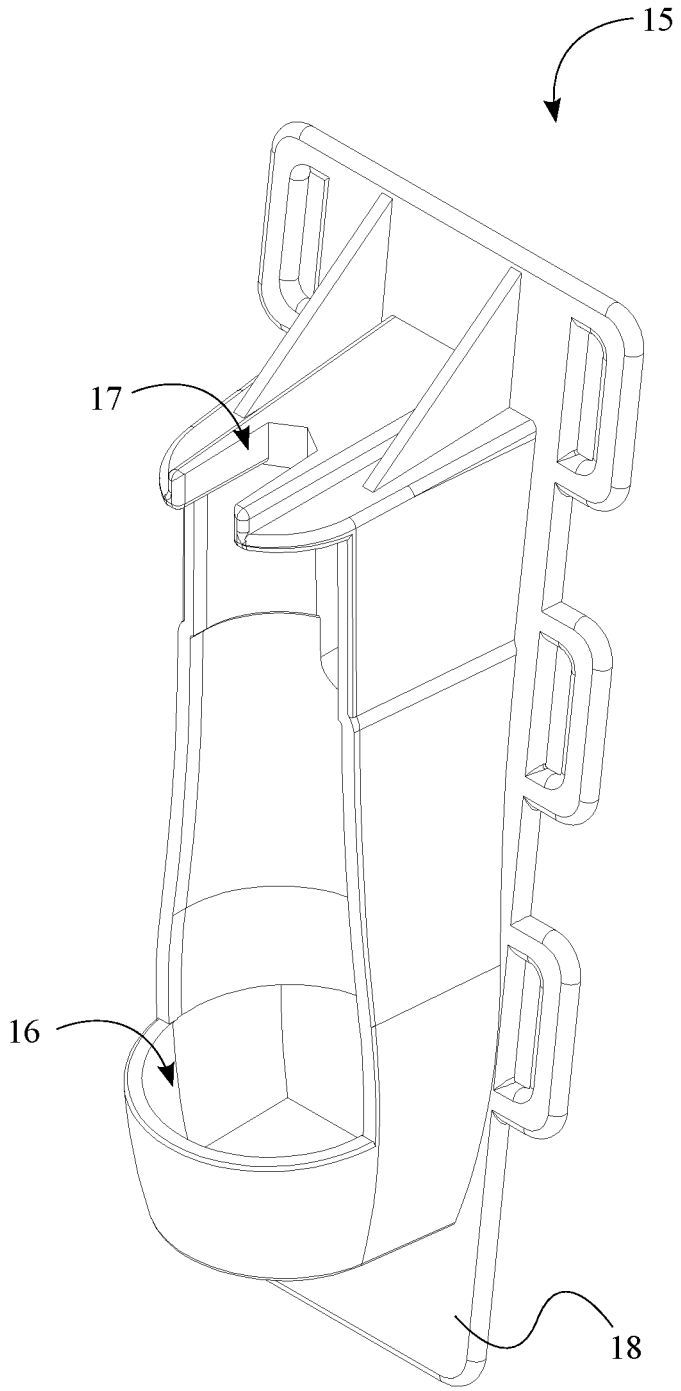
FIG. 6 is a perspective view of the holding bracket.
Figure 7:
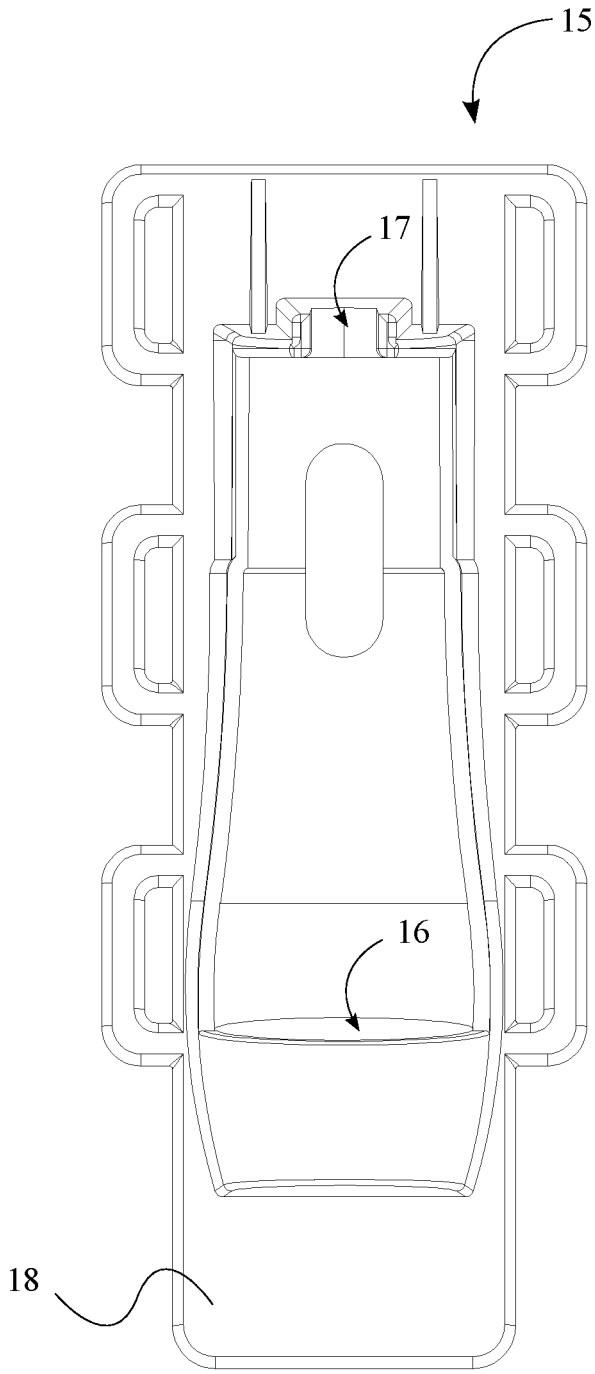
FIG. 7 is a front view of the holding bracket.
Figure 8:
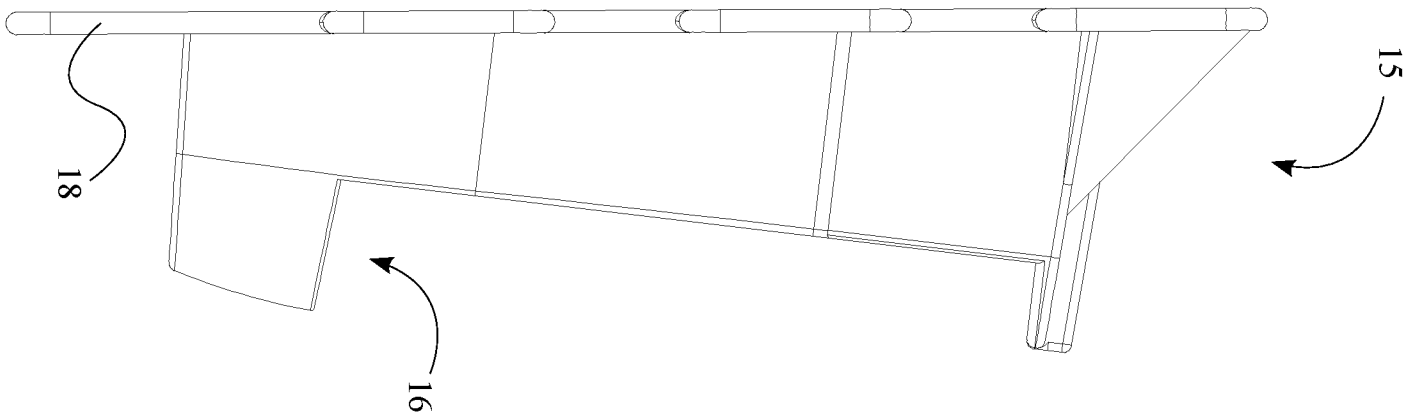
FIG. 8 is a side view of the holding bracket.

When the umbrella 11 is being used in the handsfree configuration, the umbrella 11 is mounted within the primary compartment 2. As shown in FIG. 4, the inner liner 6 of the primary compartment 2 comprises a front portion 7, a rear portion 8, and a stiffening material 30. The front portion 7 is positioned opposite the rear portion 8 such that when the backpack 1 is worn, the rear portion 8 lies against the back of the user. The holding bracket 15 which is used in the handsfree configuration is removably mounted onto the rear portion 8 positioned within the primary compartment 2. The rear portion 8 is layered atop the stiffening material 30 which helps in holding the umbrella 11 and provides additional support to carry the backpack 1. A honeycomb material is used as the stiffening material 30 in the preferred embodiment of the present invention. However, different stiffening materials can be used in other embodiments of the present invention. As shown in FIGS. 6-8, to utilize the umbrella 11 in the handsfree configuration, the holding bracket 15 comprises a handle receiving slot 16, a shaft-receiving channel 17, and a positioning tab 18. The positioning tab 18 is terminally connected to the handle receiving slot 16. The shaft-receiving channel 17 is also terminally connected to the handle receiving slot 16 but opposite to the positioning tab 18. When the holding bracket 15 is mounted onto the rear portion 8, the handle receiving slot 16 is positioned at an acute angle from the rear portion 8. Thus, when the handle 12 is positioned into the handle receiving slot 16, the umbrella 11 is oriented away from the user so that the shaft 13 does not contact the head of the user in the handsfree configuration. The shaft 13, which extends from the handle 12, is positioned into the shaft-receiving channel 17 which is terminally connected to the handle receiving slot 16. In the preferred embodiment of the present invention, the shaft 13 has a hexagonal cross section. To accommodate the hexagonal cross section, the shaft-receiving channel 17 has a hexagonal cross section so that the shaft 13 remains stationary within the shaft-receiving channel 17.

In addition to holding the umbrella 11 in the handsfree configuration, the holding bracket 15 also allows the umbrella 11 to be positioned at different heights via the positioning tab 18. To do so, the present invention further comprises a plurality of height-adjusting pockets 19. Each of the plurality of height-adjusting pockets 19 are linearly positioned along the rear portion 8 as shown in FIG. 2. In other words, each of the plurality of height-adjusting pockets 19 are vertically arranged along the rear portion 8 so that the user can select a preferred height. To adjust the height of the holding bracket 15, the positioning tab 18 is removably positioned into a corresponding pocket of the plurality of height-adjusting pockets 19. In the preferred embodiment of the present invention, the positioning tab 18 is rectangular in shape. To accommodate the rectangular shape, each of the plurality of height-adjusting pockets 19 are also shaped to be rectangular. However, the shape and size of the positioning tab 18 and each of the plurality of height-adjusting pockets 19 can vary in different embodiments of the present invention. The ability to remove and reposition the holding bracket 15 allows the user to replace the holding bracket 15 if required.

Figure 9:
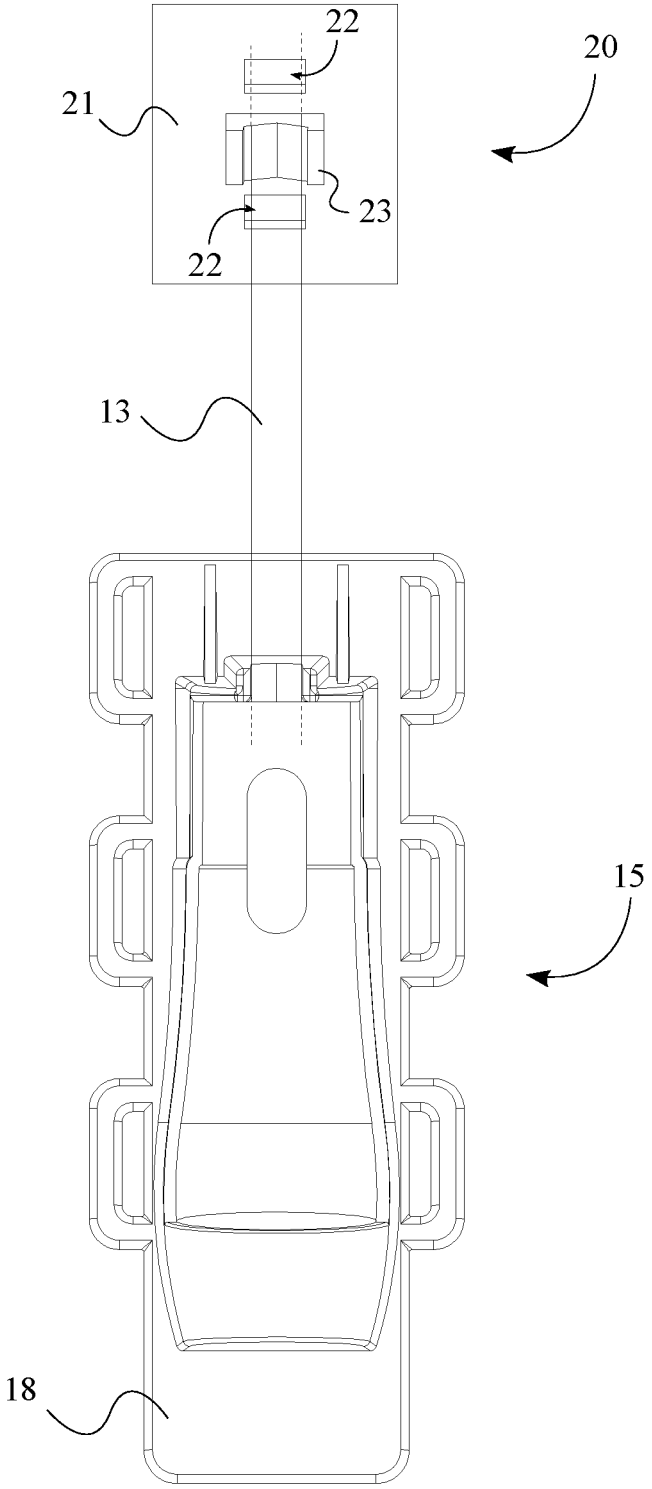
FIG. 9 is a front view of the holding bracket and the anchoring bracket, wherein the shaft is positioned into the shaft-receiving channel and the shaft-receiving tab.
Figure 10:
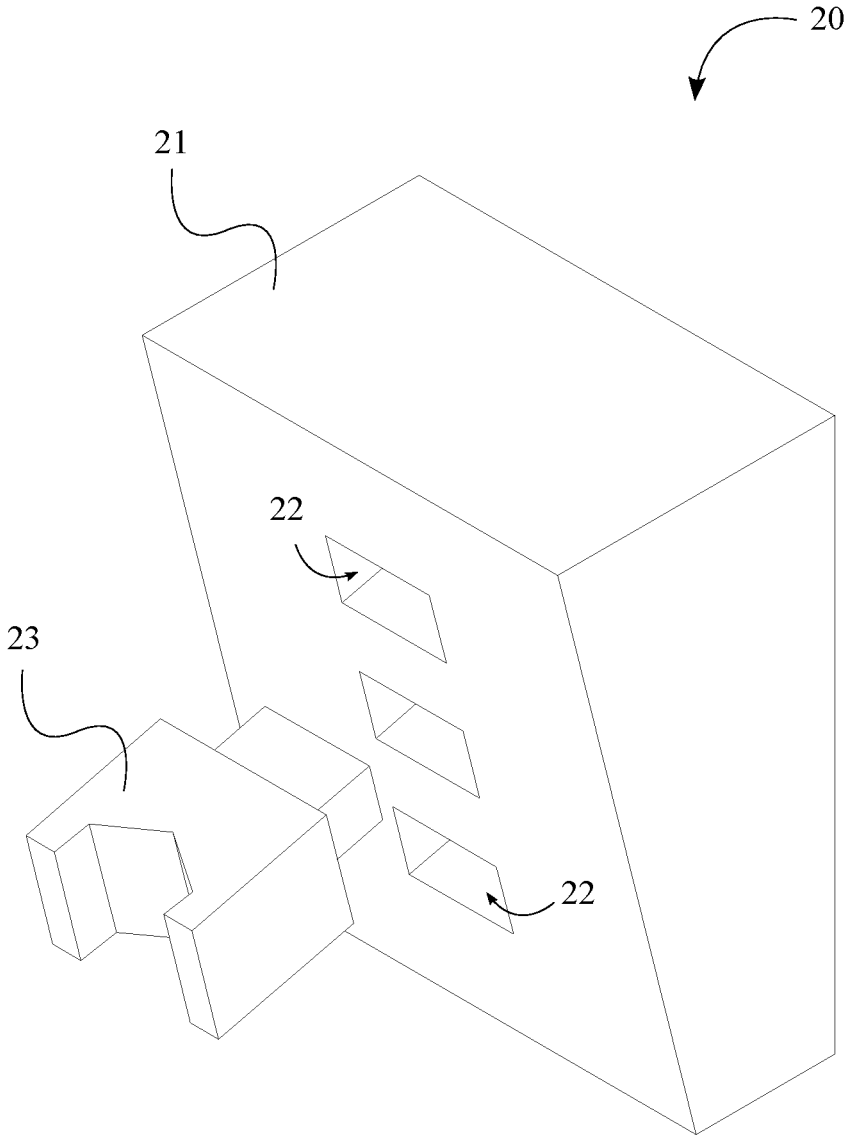
FIG. 10 is a perspective view of the anchoring bracket.

As illustrated in FIG. 9 and FIG. 10, in addition to the holding bracket 15, the present invention further comprises an anchoring bracket 20 that is used to balance the umbrella 11 with varying height levels. In particular, the anchoring bracket 20 provides a second holding point for the shaft 13, wherein the first holding point is the shaft-receiving channel 17. As an example, if the holding bracket 15 is positioned at a topmost pocket of the plurality of height-adjusting pockets 19, the anchoring bracket 20 is used to hold the shaft 13 and prevent the umbrella 11 from tilting over as the shaft 13 extends out of the primary compartment 2. To do so, the anchoring bracket 20 is mounted onto the rear portion 8 within the primary compartment 2 adjacent to the holding bracket 15. To hold the shaft 13, the anchoring bracket 20 comprises a structural body 21, a plurality of height-adjustable slots 22, and a shaft-receiving tab 23. The plurality of height-adjustable slots 22 traverse into the structural body 21. The shaft-receiving tab 23 is removably positioned into a corresponding slot of the plurality of height-adjustable slots 22. In particular, depending on the height chosen by the user, the shaft-receiving tab 23 is repositioned along the plurality of height-adjustable slots 22. Thus, when the umbrella 11 is used in the handsfree configuration, the handle 12 is positioned into the handle receiving slot 16 and the shaft 13 is positioned into both the shaft-receiving channel 17 and then the shaft-receiving tab 23.

To further ensure that the umbrella 11 remains stationary during the handsfree configuration, the present invention further comprises a retainer mechanism 24 that can vary in different embodiments of the present invention. In the preferred embodiment, a plurality of hook and loop fasteners is used as the retainer mechanism 24. Therefore, during the handsfree configuration, the umbrella 11 is removably positioned within the holding bracket 15 with the retainer mechanism 24. Moreover, the umbrella 11 is removably positioned within the anchoring bracket 20 with the retainer mechanism 24.

In the handsfree configuration, the umbrella 11 vertically extends from the primary compartment 2. To position the umbrella 11 in the most effective position with minimum hindrance from the rim 5 of the primary compartment 2, the present invention further comprises a shaft-positioning slit 25 and a double-sided zipper 26. The shaft-positioning slit 25 eliminates the need to utilize the opening 9 delineated by the inner liner 6 of the primary compartment 2. To do so, the shaft-positioning slit 25 perpendicularly extends from the opening 9 delineated by the inner liner 6 of the primary compartment 2. Since the shaft 13 extends vertically, the shaft-positioning slit 25 is positioned at a vertex of the opening 9 so that the shaft 13 can be positioned within the shaft-positioning slit 25. The double-sided zipper 26 secures the shaft within the shaft-positioning slit 25 in two opposing directions by being operatively engaged along the shaft-positioning slit 25.

As discussed earlier, the present invention intends to serve all needs of an individual participating in an outdoor activity. To do so, the present invention further comprises a thermally insulated compartment 10 that is positioned adjacent the plurality of secondary compartments 3. The thermally-insulated compartment 10 can be used for storing a cold beverage or other comparable item that is used during an outdoor event. In another embodiment, the present invention further comprises a bladder 27 that is removably positioned within the thermally-insulated compartment 10. A water hose extending from the bladder 27 can be positioned along the backpack 1 for easy access.

When the backpack 1 is worn for an extended time, the weight of the items stored in the backpack 1 applies a considerable force on the back and shoulders of the user. To minimize the force applied on the user, the present invention further comprises a pair of hip straps 28 and a pair of chest straps 29. The pair of hip straps 28 is terminally connected to a back surface 31 of the backpack 1. On the other hand, each of the pair of chest straps 29 extend from the back surface 31 of the backpack 1. By utilizing the pair of hip straps 28 and the pair of chest straps 29 the overall force applied on the back and shoulders of the user is equally distributed.

When the present invention is used, the following process flow is generally followed. Initially, the items that are intended to be carried are organized within the primary compartment 2 and the plurality of secondary compartments 3. The umbrella 11 is stored within the waterproof compartment 4. If available, the bladder 27 is positioned within the thermally insulated compartment 10. When organizing the backpack 1 is complete, the backpack 1 is worn on the shoulders of the user. The pair of hip straps 28 and the pair of chest straps 29 are used for additional support. When the umbrella 11 needs to be used, the umbrella 11 is removed from the stored configuration. Then, according to user preference, the umbrella 11 can be handheld or used in the handsfree configuration. In the handsfree configuration, the handle 12 is positioned into the handle receiving slot 16 and the shaft 13 is positioned into the shaft-receiving channel 17. The shaft 13 is also positioned into the shaft-receiving tab 23 of the anchoring bracket 20. If the positioning of the umbrella 11 needs to change, the positioning tab 18 is removed from the corresponding pocket and positioned in a different pocket of the plurality of height-adjusting pockets 19. Subsequently, the shaft-receiving tab 23 is also repositioned accordingly along the anchoring bracket 20. When the umbrella 11 is not needed, the umbrella 11 is repositioned into the waterproof compartment 4. The waterproof properties ensure that other items within the backpack 1 are not water damaged.

Although the invention has been explained in relation to its preferred embodiment, it is to be understood that many other possible modifications and variations can be made without departing from the spirit and scope of the invention as hereinafter claimed.

What is claimed is:

1. A multifunctional backpack with umbrella holder comprising:

a backpack;

an umbrella;

a holding bracket;

the backpack comprising a primary compartment, a plurality of secondary compartments and a waterproof compartment;

the holding bracket being removably positioned within the primary compartment;

the plurality of secondary compartments being adjacently positioned to the primary compartment;

the waterproof compartment being adjacently positioned to the primary compartment;

the umbrella being removably positioned within the waterproof compartment;

the umbrella being in a stored configuration while positioned within the waterproof compartment;

the umbrella being removably positioned into the holding bracket;

the umbrella being in a handsfree configuration while positioned into the holding bracket;

the holding bracket comprising a handle receiving slot, a shaft-receiving channel and a positioning tab;

the positioning tab being terminally connected to the handle receiving slot;

the shaft-receiving channel being terminally connected to the handle receiving slot;

the handle receiving slot being connected in between the positioning tab and the shaft-receiving channel;

the positioning tab being rectangular in shape;

a plurality of height-adjusting pockets;

the plurality of height-adjusting pockets being positioned within the primary compartment;

the plurality of height-adjusting pockets being linearly positioned along the primary compartment;

each of the plurality of height-adjusting pockets being rectangular in shape;

the positioning tab being removably positioned into a corresponding height-adjusting pocket among the plurality of height-adjusting pockets;

an anchoring bracket;

the anchoring bracket comprising a structural body, a plurality of height-adjustable slots and a shaft-receiving tab;

the anchoring bracket being mounted adjacent the holding bracket within the primary compartment;

the shaft-receiving tab being removably positioned into a corresponding height-adjustable slot among the plurality of height-adjustable slots;

the umbrella comprising a shaft; and the shaft comprising a hexagonal cross section.

2. The multifunctional backpack with umbrella holder as claimed in claim 1 comprising:

the umbrella comprising a handle and a canopy;

the handle being terminally connected to the shaft; and the canopy being terminally connected to the shaft opposite to the handle.

3. The multifunctional backpack with umbrella holder as claimed in claim 2 comprising:

the canopy being elongated in shape.

4. The multifunctional backpack with umbrella holder as claimed in claim 2 comprising:

an inner surface of the canopy comprising an ultraviolet (UV) coating.

5. The multifunctional backpack with umbrella holder as claimed in claim 1 comprising:

the primary compartment, the plurality of secondary compartments and the waterproof compartment each comprising a rim and an inner liner; and the rim being perimetrically connected along an opening delineated by the inner liner.

6. The multifunctional backpack with umbrella holder as claimed in claim 5 comprising:

the inner liner of the primary compartment comprising a front portion, a rear portion and a stiffening material;

the front portion being oppositely positioned to the rear portion;

the rear portion being layered atop the stiffening material; and the holding bracket being removably mounted onto the rear portion.

7. The multifunctional backpack with umbrella holder as claimed in claim 6 comprising:

the plurality of height-adjusting pockets being linearly positioned along the rear portion.

8. The multifunctional backpack with umbrella holder as claimed in claim 6 comprising:

the anchoring bracket being mounted onto the rear portion.

9. The multifunctional backpack with umbrella holder as claimed in claim 1 comprising:

a retainer mechanism; and the umbrella being removably positioned within the holding bracket via the retainer mechanism.

10. The multifunctional backpack with umbrella holder as claimed in claim 1 comprising:

a retainer mechanism; and the umbrella being removably positioned within the anchoring bracket via the retainer mechanism.

11. The multifunctional backpack with umbrella holder as claimed in claim 1 comprising:

a shaft-positioning slit;

a double-sided zipper;

the shaft-positioning slit perpendicularly extending from an opening delineated by an inner liner of the primary compartment;

the shaft-positioning slit being positioned at a vertex of the opening; and the double-sided zipper being operatively engaged along the shaft-positioning slit.

12. The multifunctional backpack with umbrella holder as claimed in claim 1 comprising:

the backpack comprising a thermally insulated compartment; and the thermally insulated compartment being adjacently positioned to the plurality of secondary compartments.

13. The multifunctional backpack with umbrella holder as claimed in claim 12 comprising:

a bladder; and the bladder being removably positioned within the thermally insulated compartment.

14. The multifunctional backpack with umbrella holder as claimed in claim 1 comprising:

a pair of hip straps; and the pair of hip straps being terminally connected to a back surface of the backpack.

15. The multifunctional backpack with umbrella holder as claimed in claim 1 comprising:

a pair of chest straps; and each of the pair of chest straps extending out from a back surface of the backpack.

* * * * *